US007258094B1

(12) United States Patent
Pelmear

(10) Patent No.: US 7,258,094 B1
(45) Date of Patent: Aug. 21, 2007

(54) ENGINE BLOCK COMPONENT BRACE

(76) Inventor: Douglas A Pelmear, 218 Thomas Ave., Napoleon, OH (US) 43545

( * ) Notice: Subject to any disclaimer, the term of this patent is extended or adjusted under 35 U.S.C. 154(b) by 41 days.

(21) Appl. No.: 11/235,910

(22) Filed: Sep. 27, 2005

(51) Int. Cl.
*F02F 7/00* (2006.01)
*F02B 75/22* (2006.01)

(52) U.S. Cl. ..... 123/195 R; 123/54.4; 123/195 H

(58) Field of Classification Search ..... 123/54.4–54.8, 123/195 R, 195 H
See application file for complete search history.

(56) References Cited

U.S. PATENT DOCUMENTS 2,991,774 A * 7/1961 Rarey ..... 123/54.7
4,969,441 A * 11/1990 Komurasaki et al. .... 123/406.4
5,937,804 A * 8/1999 Kaminski ..... 123/54.7
6,928,974 B1 8/2005 Markou

FOREIGN PATENT DOCUMENTS

JP 01110860 A * 4/1989

* cited by examiner

*Primary Examiner*—Noah P. Kamen
(74) *Attorney, Agent, or Firm*—Van Dyke, Gardner, Linn & Burkhart, LLP

(57) ABSTRACT

One or more component braces may be installed into the upper valley of a V-styled engine block to provide resistance to deformation of the block when used in an operating motor. The component braces include first and second mounting portions separated by a body portion, where the mounting portions may be constructed as arms extending from the body portion. An intermediate mounting portion may also be included that is centrally located with respect to the first and second mounting portions, but below a line defined by the first and second mounting portions. The securing of the component brace at the mounting areas provides rigidity to the upper portion of the engine block to resist deformation, such as would occur as relative movement between the cylinder banks. The resistance to such deformation aids in the prevention of cylinder bore wall distortion as well as engine block cracking.

22 Claims, 7 Drawing Sheets

ENGINE BLOCK COMPONENT BRACE

BACKGROUND OF THE INVENTION

The present invention is directed to preventing deformation of an engine block of a motor, and in particular to a brace for mounting to an engine block to prevent deformation.

Many of the components of reciprocating motors, such as automobile, light truck, and heavy-duty motors, are subjected to high loads during operation. One such component subjected to high operational loads is the engine block or block, which experience loads from the combustion events occurring in the combustion chambers formed by the cylinder heads, pistons, and cylinder bores of the block. These forces are transmitted to the engine block at, amongst other locations, the cylinder heads and the crankshaft, which is mounted to the engine block.

A portion of the forces that are applied to the engine block are imparted in a non-linear dynamic manner due to the alternating firing sequence of the pistons and the reciprocating connection of the connecting rods to the pistons and crankshaft. These forces impart strain on the engine block, which results in distortion and can even lead to failure of the engine block.

Various locations on the engine block will be subjected to distortion from twisting, compressive, and/or tensional forces. The cylinder bores are one such area subject to distortional strains, with this area experiencing significant distortion due to their proximity to the origin of the forces and the relatively narrow walls of the cylinder bores.

Distortion to the cylinder bores can be very problematic to the operation of reciprocating motors. For example, during the compression cycle of the piston distortion to the cylinder bore can reduce the amount of compression in the cylinder by allowing the gas and air mixture to escape past the piston rings, thus reducing the amount of gas and air in the cylinder prior to firing. Furthermore, upon a combustion event, the burnt gasses can escape past the piston rings and reduce the force transmitted to the crankshaft, thus further reducing the power output of the motor. In addition, such distortion can improperly allow the discharging of combustion exhaust gasses into the oil pan area, and allow oil to enter the combustion chamber and increase harmful emissions. Distortion to the engine block cylinder bores, therefore, reduces the efficiency of a reciprocating motor as measured by the amount of fuel consumed relative to the power output, thus necessitating that the motor utilize more fuel to obtain a desired power output than would otherwise be required, and can increase harmful emissions.

Distortion to the engine block can also result in total failure of the motor due to cracking of the block or can cause the piston to seize in the cylinder bore due to an excessively out of round condition of the bore. Engine blocks are most commonly constructed of cast iron, but may alternatively be constructed from aluminum, or other alloys or materials, and are relatively inelastic. Therefore, strain causing distortion can cause cracks to form in engine blocks, particularly at sharp corners or areas having thinner wall sections or at voids formed during the casting operation. The cyclic nature of the strain can cause the cracks to propagate and cause the motor to fail.

Distortion of engine blocks is a problem for all motors, whether spark ignition (SI) gasoline motors or combustion ignition (CI) diesel motors or alternative fuel burning motors. However, engine blocks formed to have a V-style configuration are particularly apt to experience distortion causing strain. V-style motors are formed to have two cylinder banks that are oriented at an angle with respect to one another and are produced in a wide variety of sizes, such as V6 and V8. V-style motors are used for SI, CI, or alternative fuel burning motors. In general, each bank of cylinders of a V-style motor extends out away from a central portion of the block and there typically exists an upper valley between the cylinder banks. The upper valley usually contains components related to actuating the engine valves and is thus referred to as a lifter valley and an intake manifold may be placed above the upper valley.

The non-linear forces resulting from the offset relationship of the pistons firing within the angled cylinder banks and the extension of the cylinder banks from the central portion of the engine block contribute to the strain causing distortion in this area of an engine block. These strains are magnified on engines subjected to high loads, such as towing vehicles or racing vehicles, but are also significant relative to the continuous drive to obtain more performance from smaller engines where the lighter weight engine blocks are constructed of less material and thus subject to higher strains.

Devices have been constructed to attempt to reduce engine block strain. For example, U.S. Pat. No. 6,928,974 issued to Markou discloses a reinforcement plate for a reciprocating engine, also known as an engine girdle, constructed for attachment to the lower portion of an engine block. However, the disclosed reinforcement plate does not provide reinforcement to the upper portion of the engine block adjacent the cylinder bores.

Therefore, a technique for reducing engine block deformation at the upper portion of V-styled motors is desired in order to increase efficiency and reduce engine block failures.

SUMMARY OF THE INVENTION

The present invention provides a component brace for attachment within the upper valley of a V-styled engine block, where one or more of the component braces may be mounted within and substantially span the upper valley of the engine block between the cylinder banks to reduce distortion of the engine block.

According to an aspect of the present invention, the component brace comprises a first mounting portion that is adapted to be secured to a first mounting area on an engine block, with the first mounting area being located proximate a first cylinder bank, a second mounting portion located distal from the first mounting portion and adapted to being secured to a second mounting area on the engine block, with the second mounting area being located proximate a second cylinder bank, and a body portion extending between and joining the first and second mounting portions. The component brace being adapted to resist deformation of the engine block when the engine block is subjected to loads in an operating motor.

According to yet another aspect of the present invention, a method of bracing the engine block of a motor having banks of cylinder bores configured in an angled arrangement to one another comprises providing at least one component brace having first and second mounting portions and a body portion extending between the first and second mounting portions, and securing the first and second mounting portions of the at least one component brace to first and second mounting areas on the engine block, where the first and second mounting areas are located in the upper valley of the engine block proximate first and second cylinder banks.

The mounting of one or more component braces in the upper valley of V-styled engine blocks provides strength to the engine block to resist deformation of the engine block when used in an operating motor. The component braces include first and second mounting portions separated by a body portion, where the mounting portions may be constructed as arms extending from the body portion. An intermediate mounting portion may also be included that is centrally located with respect to the first and second mounting portions, but below a line defined by the first and second mounting portions. The component brace thus forms an approximately inverted triangular or truss like configuration having three points of contact with three mounting areas on the engine block, with the mounting areas being located proximate the left and right cylinder banks and at the base of the upper valley. The securing of the component brace at the mounting areas provides rigidity to the upper portion of the engine block to resist deformation, such as would occur as relative movement between the cylinder banks. The resistance to such deformation aids in the prevention of cylinder bore wall distortion as well as engine block cracking. A motor constructed using an engine block having one or more component braces mounted thereto will utilize less fuel and may operate under higher loads with a reduced risk of failure.

These and other objects, advantages, and features of this invention will become apparent upon review of the following specification in conjunction with the drawings.

DESCRIPTION OF THE PREFERRED EMBODIMENTS

Figure 1:
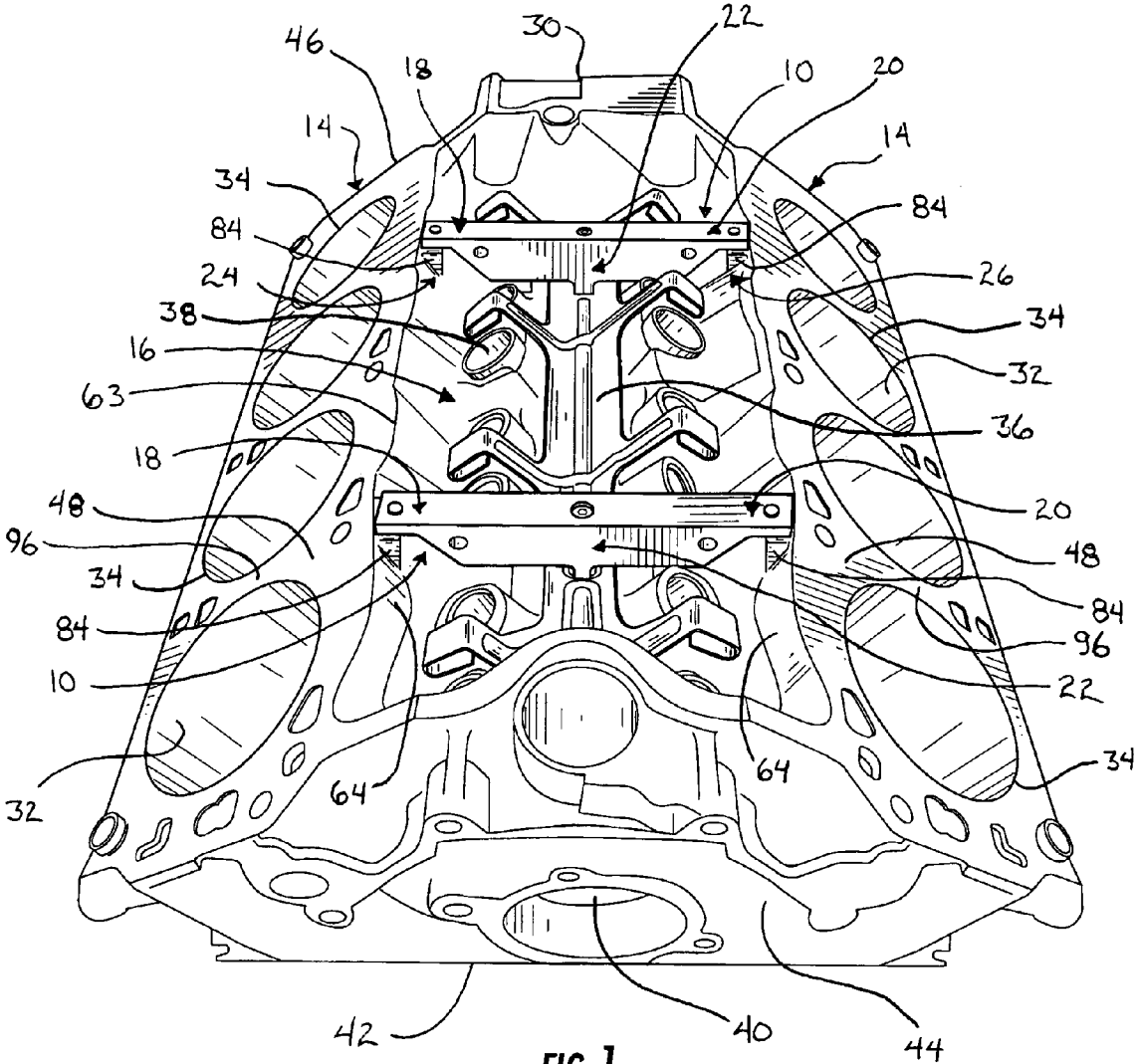
FIG. 1 is a front perspective view of an engine block to which are mounted one embodiment of the component braces of the present invention.

The present invention will now be described with reference to the accompanying figures, wherein the numbered elements in the following written description correspond to like-numbered elements in the figures. Two component braces or truss devices or ribs 10 are shown in FIG. 1 mounted to a "V" styled engine block 12, where the V configuration is formed by the angled orientation of the two cylinder banks 14 of engine block 12 with respect to one another. The component braces 10 are positioned in and substantially span the upper valley or lifter valley 16 of the engine block 12 to provide strength to engine block 12 and resist deformation of the engine block 12 when used in an operating motor.

Figure 2:
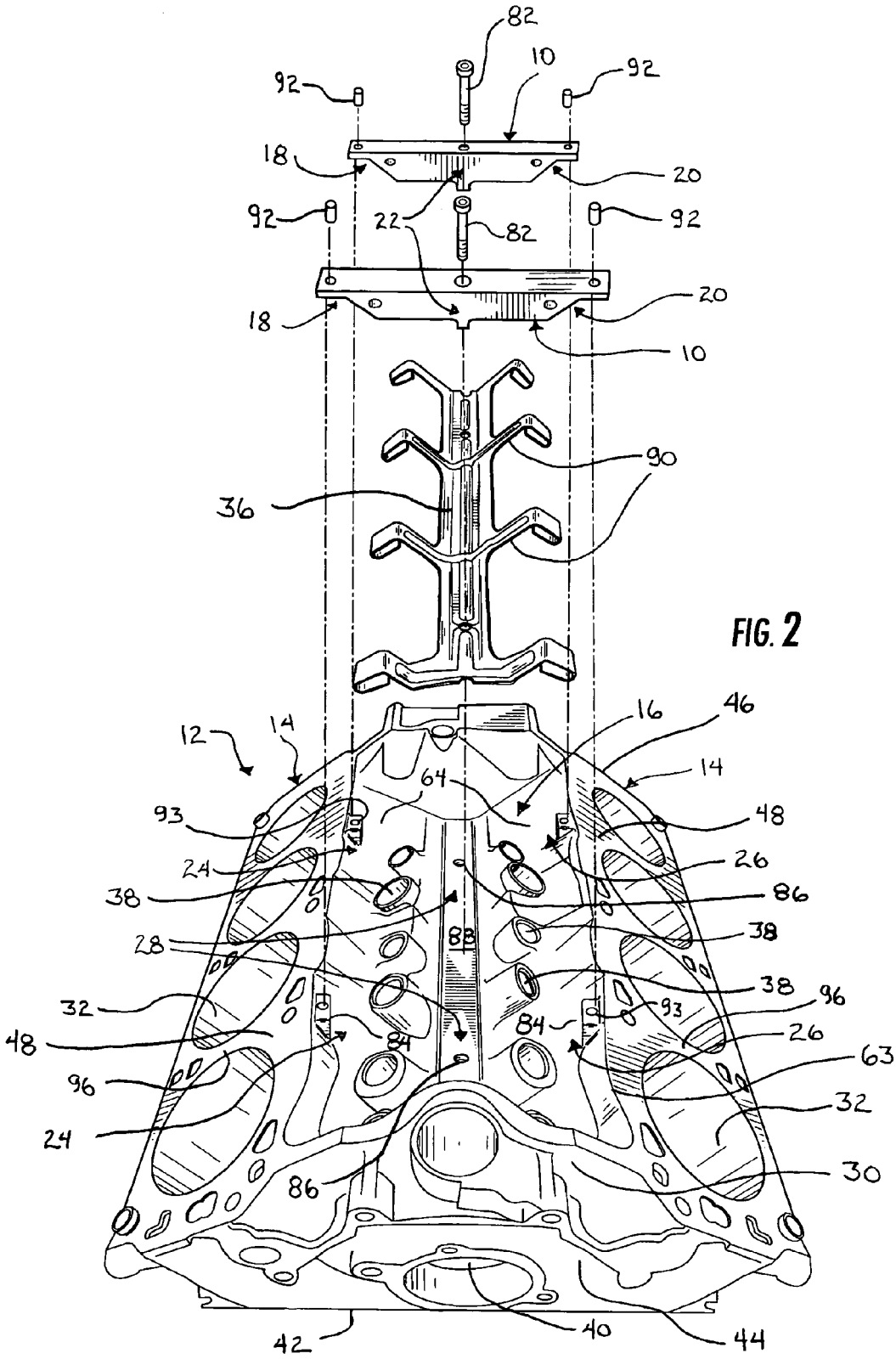
FIG. 2 is an exploded perspective view of the engine block and component braces of FIG. 1.

As generally illustrated in FIGS. 1 and 2 and described in more detail below, each component brace 10 includes first and second mounting portions or members 18, 20 and an intermediate mounting portion or member 22. The mounting portions 18, 20, 22 contact the engine block 12 at three points within the upper valley 16 in an approximately inverted triangular truss fashion. The points of contact include a first mounting area 24 proximate one of the cylinder banks 14, a second mounting area 26 proximate the other cylinder bank 14, and a third mounting area 28 located between and below the first and second mounting areas 24, 26. The securing of the component brace 10 at the first, second, and third mounting areas 24, 26, 28 provides rigidity to the upper portion 30 of the engine block 12 to resist deformation, such as would occur as relative movement between cylinder banks 14. The resistance to such deformation aids in the prevention of cylinder bore wall 32 distortion as well as engine block 12 cracking. Therefore, a motor constructed using engine block 12 having one or more component braces 10 mounted thereto will utilize less fuel and may operate under higher loads with a reduced risk of failure.

FIGS. 1 and 2 reveal that each cylinder bank 14 of engine block 12 includes four cylinder bores 34 such that the engine block 12 may be used to construct a V8 motor. FIGS. 1 and 2 also disclose a lifter tray 36 positioned within the upper valley 16 between component brace 10 and engine block 12. Lifter tray 36 is used in the retention of hydraulic roller lifters (not shown) contained within lifter holes 38.

Although not shown, but as is well known in the art of reciprocating motors, various additional components must be assembled to engine block 12 to construct an operational motor. For example, a cam shaft (not shown) is required for assembly into the cavity 40, and a crank shaft (not shown) is also required for connection to the bottom portion 42 of engine block 12. The cam shaft and crank shaft would extend from the front 44 to the back 46 of engine block 12 and are adapted to rotate within the block 12 and thus define the rotational axis of engine block 12.

An assembled motor would also include cylinder heads (not shown) mounted to cylinder decks 48 of cylinder banks 14, push rods (not shown) extending from lifter holes 38 to the cylinder heads, and an intake manifold (not shown) positioned above the upper valley 16 of the engine block 12 between the cylinder heads. It should be appreciated that the above description of components used in a reciprocating motor is not exhaustive and one skilled in the art will recognize the construction of such a motor using engine block 12.

The engine block 12 and lifter tray 36 shown in FIGS. 1 and 2 are illustrative of those manufactured by the Ford Motor Company in connection with their 302, 289, 260, and 255 cubic inch displacement (CID) V8 motors. However, as described in more detail below, it should be understood that the component braces of the present invention may be constructed for use with other V-style engine blocks having cylinder banks arranged at angles with respect to one another, whether gasoline, diesel, or alternative fuel burning, or produced by any manufacturer, foreign or domestic.

Figure 4:
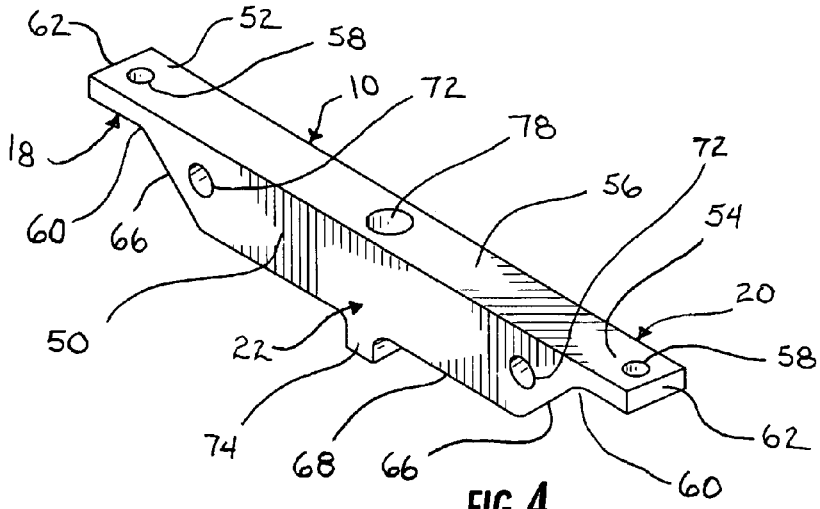
FIG. 4 is a perspective view of one of the component braces of FIG. 1 removed from the engine block.
Figure 5:
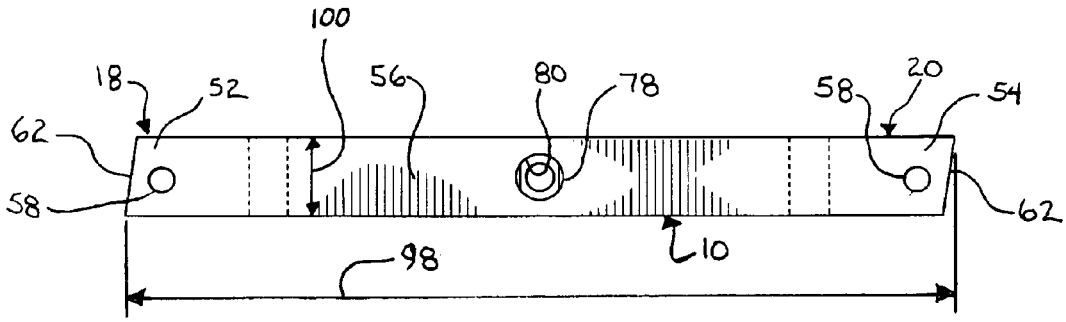
FIG. 5 is a top plan view of the component brace of FIG. 4.
Figure 6:
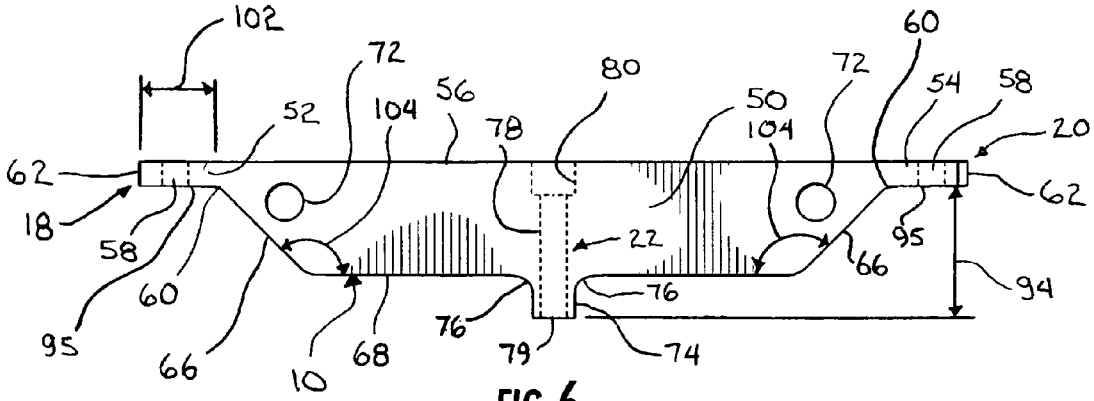
FIG. 6 is a side elevation view of the component brace of FIG. 4.

FIGS. 4–6 illustrate a component brace 10 removed from engine block 12. As noted above, the illustrated component brace 10 includes first and second mounting portions 18, 20 and intermediate mounting portion 22. Component brace 10 also includes a body portion 50 extending between first and second mounting portions 18, 20.

First and second mounting portions 18, 20 of the illustrated component brace 10 are formed as first and second mounting arms or elements or ears 52, 54. First arm 52 is located distally from second arm 54 with the arms 52, 54 extending outwardly from body portion in an approximately cantilevered or perpendicular arrangement that is co-planar with a top surface 56 of component brace 10. Each arm 52, 54 includes a mounting hole 58 that is used in the mounting of component brace 10 to engine block 12 as described below. First and second arms 52, 54 each have a radiused joint 60 at the intersection with body portion 50 to provide a stress relief. As illustrated in FIG. 5, each arm 52, 54 includes an angled end 62, with the angled ends 62 constructed to generally match the profile of the edge 63 separating cylinder deck 48 and cylinder bank side surfaces 64 when component brace 10 is installed to engine block 12. The angled profile at the edge 63 of engine block 12 results from the offset relationship of the cylinder bores 34 of one of the cylinder banks 14 to the cylinder bores 34 of the other cylinder bank 14 along the length of engine block 12.

Body portion 50 includes angled sides 66 extending downwardly from arms 52, 54 to a lower surface 68, where the angled sides 66 provide clearance 70 relative to the upper valley 16 of engine block 12 when installed in the manner described below (see FIG. 3). Body portion 50 also includes two transverse holes 72 located adjacent to first and second mounting portions 18, 20. Transverse holes 72 function to assist in the cooling of component brace 10 and thereby aid in controlling the expansion of component brace 10, as also described below.

Intermediate mounting portion 22 of component brace 10, as illustrated in FIGS. 4–6, includes a support element or member 74 extending generally vertically downwardly from lower surface 68 of body portion 50. The intersection of support element 74 with body portion 50 includes radiused corners 76 to provide stress relief. A through hole 78 extends through support element 74 from the top surface 56 of component brace 10 to the end 79 of support element 74 and includes a recessed pocket 80 adjacent top surface 56. Through hole 78 is adapted to receive a fastener 82 (FIG. 3), as described below, that is used in the mounting and securing of component brace 10 to engine block 12.

As illustrated, support element 74 is located below a plane defined by top surface 56 and is positioned substantially an equidistance from both first and second arms 52, 54. Component brace 10 thus has an approximately inverted triangular configuration formed by first and second mounting portions 18, 20 together with intermediate mounting portion 22. As noted above and described in more detail below, component brace 10 has three points of contact with engine block 12 established by first, second, and intermediate mounting portions 18, 20, 22. The approximately inverted triangular configuration of the first, second, and intermediate mounting portions 18, 20, 22, and the three points of contact thus formed, assist in providing a rigid bracing structure similar to the design concept of triangular roof trusses.

Figure 3:
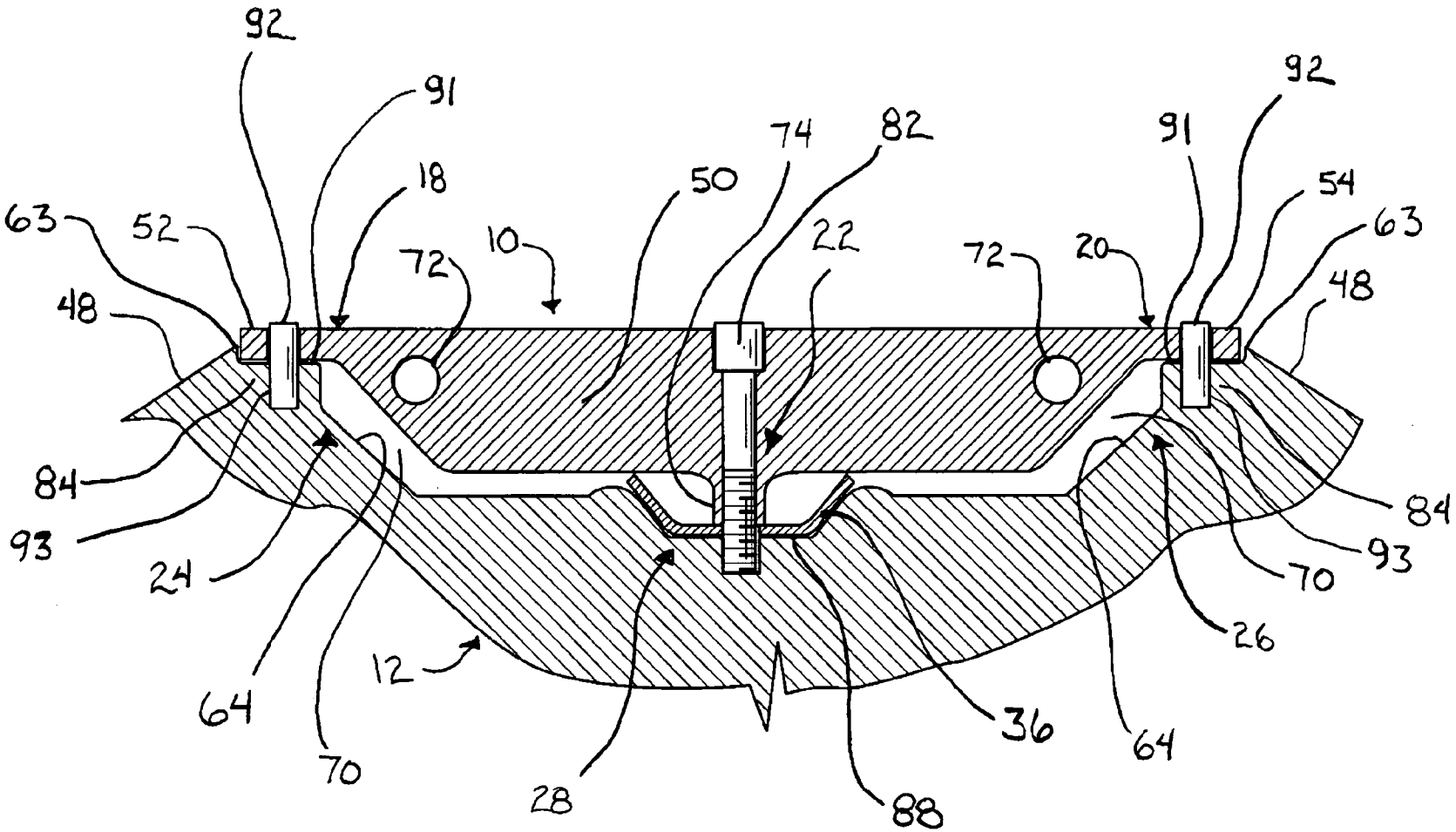
FIG. 3 is a side cross sectional view of a component brace and a portion of the engine block of FIG. 1.

Returning to engine block 12, as illustrated in FIGS. 1–3, first and second mounting areas 24, 26 of upper valley 16 include casting tabs or pads 84. The illustrated engine block 12 includes four such pads 84, with two pads 84 being located proximate each cylinder deck surface 48 along each cylinder bank 14 such that the two pads 84 adjacent one of the cylinder decks 48 align with the two pads 84 adjacent the opposite cylinder deck 48. As shown, the pads 84 align in a substantially perpendicular orientation to the rotational axis of engine block 12. The pads 84 extend from cylinder bank side surfaces 64 that are approximately perpendicular to the cylinder deck 48 and are formed during the casting of engine block 12.

FIGS. 2 and 3 also illustrate that upper valley 16 of engine block 12 includes threaded holes 86 along the base 88 of upper valley 16, with the threaded holes 86 ordinarily being adapted to receive fasteners (not shown) for securing lifter tray 36. Lifter tray 36 extends within base 88 along the length of upper valley 16 and includes arms 90 projecting towards lifter holes 38, where arms 90 function to aid in the retention of lifters (not shown). Notably, in the illustrated engine block 12, the threaded holes 86 align with pads 84 such that each combination of oppositely facing pads 84 and an aligned threaded hole 86 define a plane that is substantially orthogonal to the rotational axis of engine block 12.

In the illustrated engine block 12, the relative height difference along a vertical axis between the pads 84 and threaded holes 86 is comparatively accurately formed during manufacture of engine block 12. The relatively controlled tolerance of this vertical height difference together with the alignment of pads 84 and threaded holes 86 in the manner described above function to facilitate reception of component braces 10 in the manner described below.

FIG. 1 illustrates that component brace 10 is mounted to engine block 12 between cylinder banks 14 in a substantially transverse orientation relative to the rotational axis of engine block 12. As illustrated in FIGS. 1–3, each arm 52, 54 of component brace 10 is constructed to mount to a pad 84 using a mounting pin 92 that is installed on to the pad 84. In the illustrated embodiment, mounting pins 92 are constructed as coiled spring pins and extend out from top surface 91 of pads 84 in a generally upright vertical orientation (FIG. 3). Coiled spring pins are known, such as those manufactured by Spriol International under the SPIROL® mark, and are suited for installation into hole 93 of pad 84 in a press fit manner. It should be understood, however, that alternative mounting pins may be used within the scope of the present invention and still function as intended. For example, solid pins or slotted pins may be used, or a pin having a threaded end adapted for insertion into a threaded hole formed on a surface of the engine block.

FIG. 3 also illustrates that fastener 82 extends through hole 78 and is used in mounting component brace 10 to engine block 12. The illustrated fastener 82 is constructed as a threaded fastener, such as a bolt, and as noted is adapted to be brought into threaded engagement with threaded hole 86 located within upper valley 16 of engine block 12. FIGS. 1–3 also disclose that lifter tray 36 is positioned within base 88 of upper valley 16 between engine block 12 and intermediate mounting portion 22 when component brace 10 is mounted to engine block 12. It should also be understood that alternative fasteners may be employed, such as pins, or that component brace 10 may itself include a portion for extending into a hole located on a block. Still further, a component brace may be secured to an engine block without connection to a third mounting area.

As noted above, the relative vertical height difference between base 88 and the top surface 91 of pads 84 is fairly accurately controlled during the manufacture of engine block 12. Furthermore, the thickness of lifter tray 36, which is a metallic component formed in part by stamping, is also known. Therefore, component brace 10 may be constructed such that the height dimension 94 (FIG. 6) from the end 79 of support element 74 to the underside 95 of arms 52, 54 is substantially the same as the vertical distance from the top surface 91 of pads 84 to the top of lifter tray, thereby enabling component brace 10 to accurately mate with engine block 12.

Installation of component brace 10 to engine block 12 is accomplished as follows: Support element 74 of intermediate mounting portion 22 is initially secured to engine block 12 using fastener 82 such that arms 52, 54 are located on pads 84. Component brace 10 is then used as a jig with mounting holes 58 functioning as guides to drill holes 93 into pads 84 for receiving mounting pins 92. Upon drilling holes 93, component brace 10 is removed to clean away residual shavings. Fastener 82 is then used to reinstall component brace 10, with fastener 82 clamping lifter tray 36 between engine block 12 and support element 74 in the manner described above. A retaining compound, such as LOC-TITE® brand retaining compound, may be applied to the threaded end of fastener 82 and/or within threaded hole 86 to aid in retention of fastener 82. Mounting pins 92 are next inserted through mounting holes 58 of arms 52, 54 into the holes 93 formed in pads 84.

FIGS. 1 and 2 illustrate that first and second mounting portions 18, 20 of component brace 10 align approximately between cylinder bores 34 of cylinder banks 14. As such, the support provided by component brace 10 tends to act, at least in part, on engine block 12 along cylinder banks 14 at the walls 96 separating cylinder bores 34. It should be appreciated, however, that alternative component braces may be constructed and installed to mount within the upper valley of engine blocks at other locations relative to the cylinder bores.

As is well known, engine block 12 will undergo thermal expansion during operation in an assembled motor due to heat generating actions such as combustion and friction. Similarly, component brace 10 will also experience thermal expansion due to absorption of heat by conduction, convection, and/or radiation from engine block 12 and from other surrounding components of the motor. It should be appreciated, therefore, that it is desirable to construct component brace 10 to resist expanding or contracting at rates that would impart unwanted stresses to engine block 10. For example, if component brace 10 were to excessively expand between arms 52, 54 along the axis defined by the top surface 56, component brace 10 could impart an undesired strain on engine block 12 by acting to push apart cylinder banks 14. Similarly, if component brace 10 were to resist thermal expansion of engine block 12 between arms 52, 54, component brace 10 could impart an undesired strain in an opposite fashion. Therefore, it should be appreciated that the material properties and dimensions of component brace 10 may be cooperatively considered with the dimensions and material properties of engine block 12 during the designing of component brace 10 to avoid such undesired strains.

As noted above, the illustrated component brace 10 of FIGS. 4–6 may be used with engine blocks produced by the Ford Motor Company for motors having displacements of 302, 289, 260, and 255 cubic inches. The illustrated component brace 10, therefore, provides one construction in which the dimensions, features, and materials are selected for compatibility with this family of motors. It should be appreciated, however, that alternative component braces employing different materials, dimensions, and features may also be used to create component braces for reinforcing V-styled engine blocks and still function as intended within the scope of the present invention.

For the engine blocks 12 for the above noted Ford Motor Company motors, the illustrated component brace 10 may be constructed of SAE 1018 cold-rolled steel and provided with a black oxide coating. Referring to FIGS. 5 and 6, component brace 10 has an overall length 98 of approximately 7.75 inches and a width 100 of approximately 0.75 inches. The arms 52, 54 have a length 102 of approximately 0.75 inches and the height 94 of component brace 10 from the end 79 of support element 74 to the underside 95 of arms 52, 54 is approximately 1.188 inches. Angled sides 66 of body portion 50 form an angle 104 of approximately 135 degrees relative to lower surface 68.

It should be appreciated that component brace 10 may be alternatively constructed and/or installed and still function as intended within the scope of the present invention. For example, although lifter tray 36 is illustrated as being included on engine block 12 in FIGS. 1–3, it should be appreciated that motors may be constructed using engine block 12 without lifter tray 36. In such an embodiment, one or more shims may be installed between support element 74 and base 88 of upper valley 16 to compensate for the removal of lifter tray 36 and enable component brace 10 to accurately mount to engine block 12. Instead, however, component brace 10 may be constructed to have, for example, a support element 74 that extends from body portion 50 further as compared to height 94 of support element 74 of component brace 10 such that the component brace 10 is able to establish three points of contact without a lifter tray 36 or shims.

In addition, although FIGS. 1 and 2 illustrate the use of two component braces 10 with engine block 12, it should be understood that only one component brace 10 may be used, or that more component braces 10, such as three or four, for example, may be used with engine block 12 to provide resistance to deformation when subjected to loads as an operating motor.

Component brace 10 may be alternatively constructed for use with engine blocks used in the production of motors having a 351 CID manufactured by the Ford Motor Company, such as motors being commonly referred to as "351 Windsor" motors based on their origin of production. Such an alternative component brace includes arms 52, 54, a support element 74, through hole 78, and transverse holes 72, like component brace 10. However, based on the engine block geometry of 351 Windsor motors, the overall length 98 of the component brace 10 is approximately 9.25 inches, the dimension 94 from the end 79 of the support element 74 to the underside 95 of the arms 96 is 2.175 inches, and the width 10 of the component brace is approximately 0.26 inches.

Figure 7:
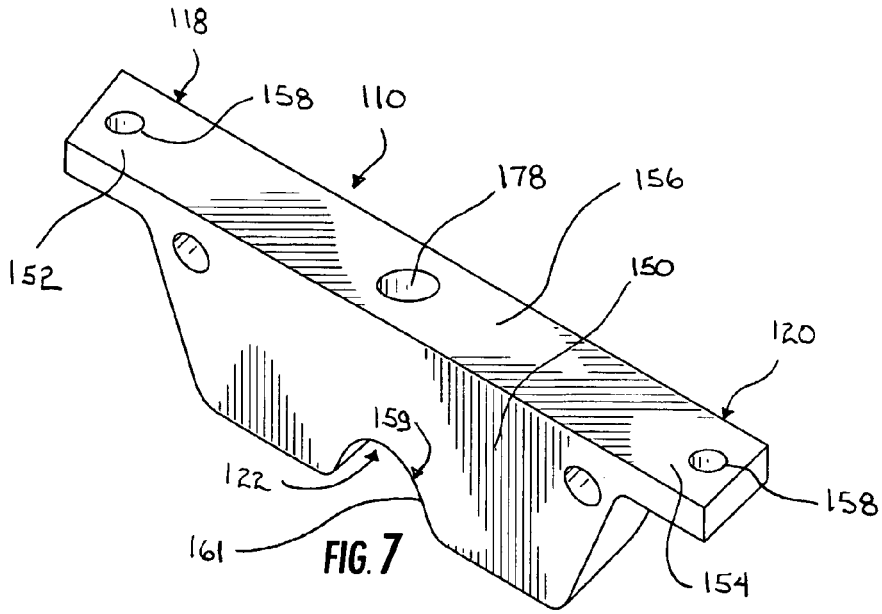
FIG. 7 is a perspective view of another embodiment of a component brace of the present invention.
Figure 8:
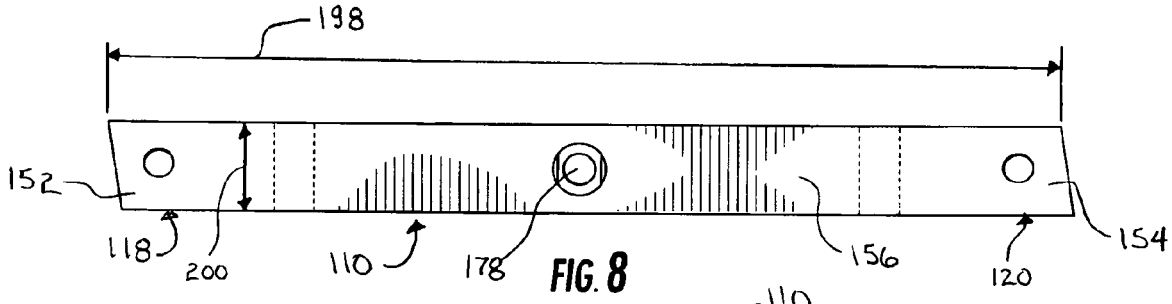
FIG. 8 is a top plan view of the component brace of FIG. 7.
Figure 9:
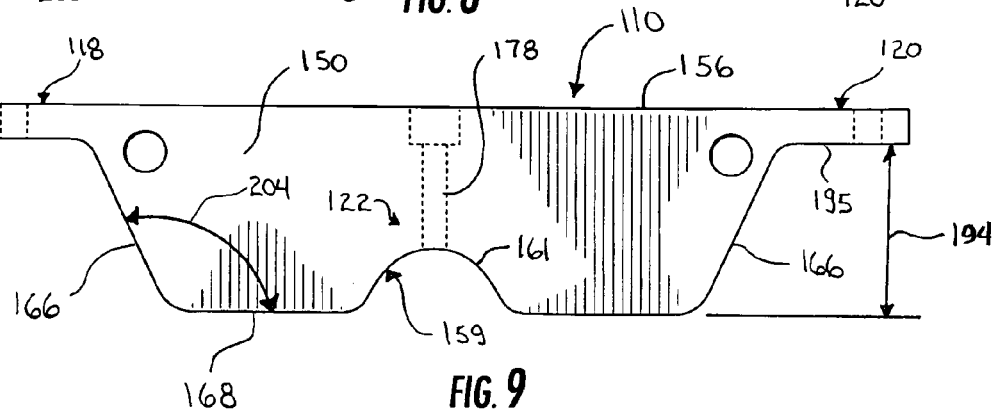
FIG. 9 is a side elevation view of the component brace of FIG. 8.

FIGS. 7–9 illustrate another embodiment of a component brace 110 that may be used with the engine block (not shown) of a 350 CID motor produced by the Chevrolet division of the General Motors Corporation, commonly referred to as a "350 Chevy." Component brace 110 is of similar construction to component brace 10 discussed above, where the similar components or elements of component brace 110 are shown with similar reference numbers as used in FIGS. 1–6 with reference to component brace 10, but with 100 added to the reference numbers of FIGS. 1–6. It should be understood that, because of the similarity of component brace 110 to component brace 10, not all of the specific construction and alternatives of like referenced parts will be discussed in the following discussion of component brace 110.

Referring to FIGS. 7–9, component brace 110 includes first and second mounting portions 118, 120 and an intermediate mounting portion 122, as well as a body portion 150 extending between first and second mounting portions 118, 120. The first and second mounting portions 118, 120 of component brace 110 are formed as first and second mounting arms or elements or ears 152, 154 that are positioned distally from one another and extend outwardly from body portion 150 in an approximately cantilevered or perpendicular arrangement that is co-planar with a top surface 156 of component brace 110. Arms 152, 154 include mounting holes 158 and are adapted to be mounted to first and second mounting areas on the engine block, where the first and second mounting areas are configured as casting tabs in a similar manner as pads above with mounting pins (not shown) being securable to the tabs that are adapted for receiving the mounting holes 158. Component brace 110 has an overall length 198 of approximately 7.875 inches, a width 200 of approximately 0.75 inches, and a height 194 of approximately 1.50 inches from lower surface 168 to the underside 195 of arms 152, 154. Angled sides 166 form an angle 204 of approximately 115 degrees relative to lower surface 168.

As illustrated in FIGS. 7–9, intermediate mounting portion 122 of component brace 110 is configured with a receptacle element 159 extending into body portion 150. Receptacle element 159 is illustrated as a substantially concave arched portion 161 that is adapted to receive a correspondingly substantially convex arched configured third mounting area on the engine block. The third mounting area on the engine block for a 350 Chevy comprises an oil passage or gallery extending along the length of the upper valley of the engine block. Intermediate mounting portion 122 also includes a through hole 178 extending from top surface 156 to receptacle element 159, with through hole 178 adapted to receive a fastener for securing component brace 110 to the engine block.

Arms 152, 154 of component brace 110, as noted above, are adapted to mount to tabs when installed to the engine block. However, when so mounted, a corresponding hole in the engine block for receipt of a fastener installed into the through hole 178 does not exist on the block as produced from the factory. Therefore, installation of the component brace 110 embodied in FIGS. 7–9 requires the drilling and tapping of a hole, such as a ¼"-20 style hole, into the oil passage. A sealant/retaining compound, such as a LOCTITE® brand sealant/retaining compound, must then be applied to the fastener and tapped hole to prevent the leakage of oil out of the passage.

Figure 10:
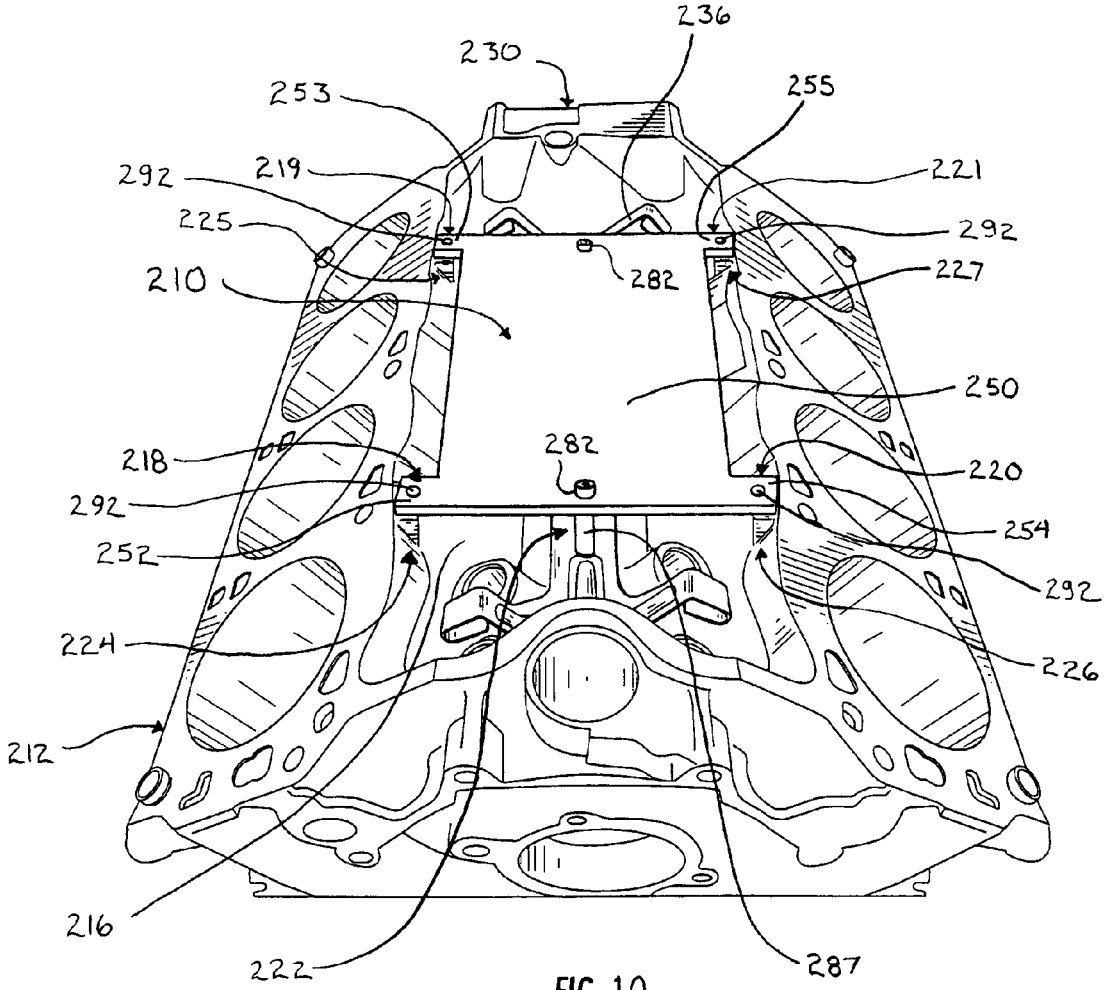
FIG. 10 is a front perspective view of yet another embodiment of a component brace of the present invention mounted to an engine block.
Figure 11:
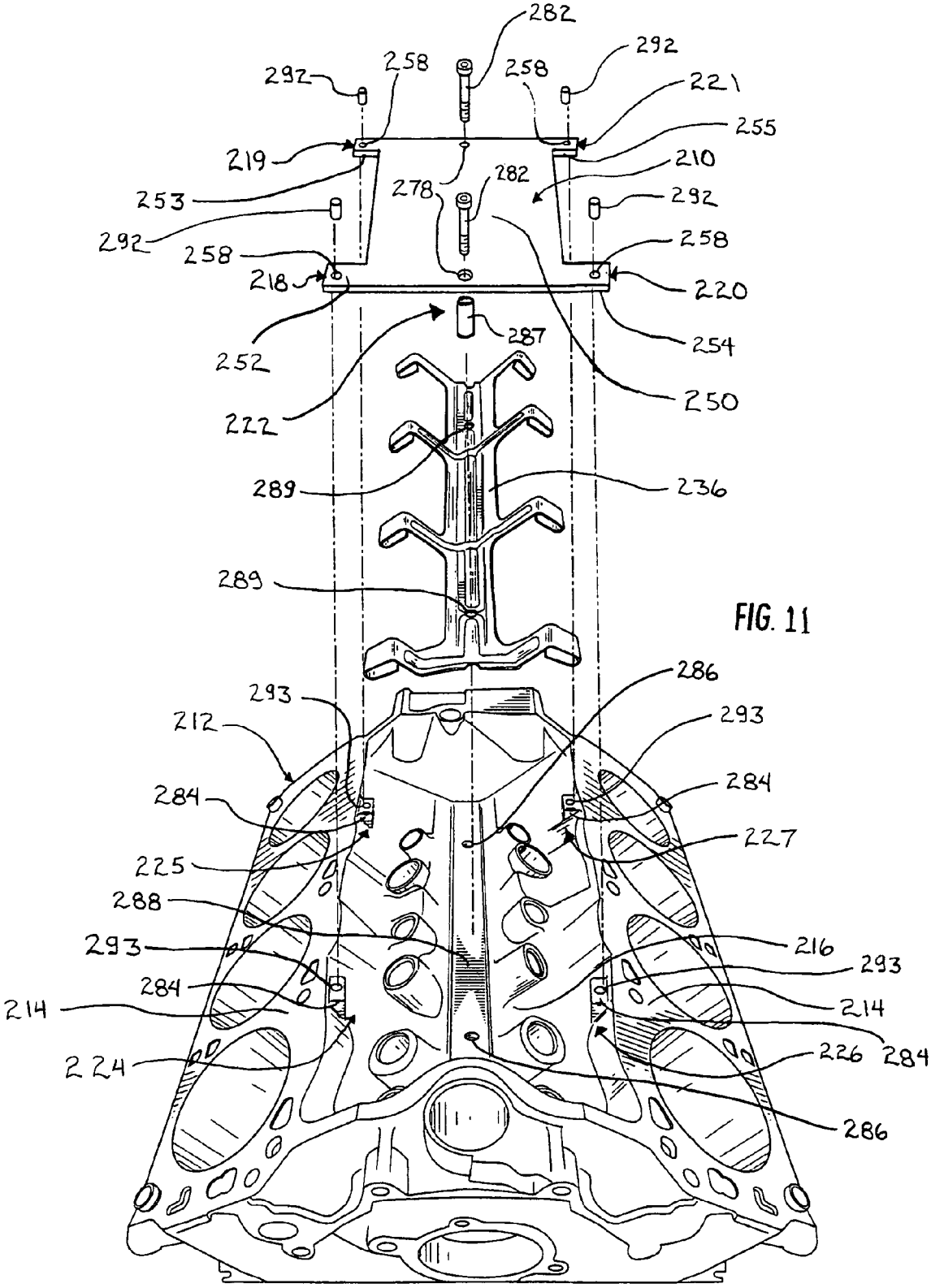
FIG. 11 is an exploded perspective view of the engine block and component brace of FIG. 10.

FIGS. 10 and 11 illustrate another embodiment of a component brace or truss device 210 that may be used with engine block 212, where engine block 212 may be used in connection with a 429 or 460 CID motor produced by the Ford Motor Company. Component brace 210 is of similar construction to component braces 10 and 110 discussed above, where the similar components or elements of component brace 210 are shown with similar reference numbers as used in FIGS. 1–9 with reference to component braces 10 and 110, but with 200 added to the reference numbers of FIGS. 1–6 and 100 added to the reference numbers of FIGS. 7–9. It should be understood that, because of the similarity of component brace 210 to component braces 10 and 110, not all of the specific construction and alternatives of like referenced parts will be discussed in the following discussion of component brace 110.

Component brace 210, as illustrated in FIGS. 10 and 11, is constructed to be mounted at the upper valley 216 of engine block 212 between the opposed cylinder banks 214. Component brace 210, as with component braces 10 and 110, functions to support or brace the top side or upper portion 230 of block 212 to provide resistance to deformation. As illustrated, component brace 210 is mounted above lifter tray 236, but as with the above component braces 10, 110, lifter tray 236 may be optionally not included and component brace 210 would still function as intended within the scope of the present invention.

Referring to FIGS. 10 and 11, component brace 210 is generally planar in construction and constructed of SAE 1018 cold-rolled steel and includes a black oxide coating. Component brace 210 includes first and second mounting portions 218, 220, as well as third and fourth mounting portions 219, 221 and a central body portion 250. First and second mounting portions 218, 220 are adapted to mount to first and second mounting areas 224, 226 on engine block 212, and third and fourth mounting portions 219, 221 are adapted to mount to third and fourth mounting areas on engine block 212. In similar manner to component braces 10 and 110, first, second, third, and fourth mounting portions 218, 220, 219, 221 are configured as first, second, third, and fourth mounting arms or elements or ears 252, 254, 253, and 255, respectively, and include mounting holes 258. Likewise, first, second, third, and fourth mounting areas 252, 254, 253, 255 of block 212 are constructed as casting tabs or pads 284 that may be machined to include holes 293. The four pads 284 are formed during casting of engine block 212 and are generally held to relatively accurate dimensional tolerances with respect to one another and the base 288 or upper valley 216.

As illustrated, component brace 210 is mounted to pads 284 by inserting mounting pins 292, which are constructed as coiled spring pins in the embodiment shown, but may alternatively be slotted pins, solid pins, or the like, into holes 293. Fasteners 282, which in the illustrated embodiment shown are threaded fasteners, are then passed through both holes 278 and through intermediate mounting portions 222, with the intermediate mounting portions 222 of the illustrated embodiment constructed as sleeves 287. Although only one sleeve 287 is shown, it should be appreciated that two sleeves 287 are utilized in the embodiment of FIGS. 10 and 11, with a sleeve 287 being located below component brace 210 and above lifter tray 236 and aligned with each hole 278 on component brace 210 such that the fasteners 282 are able to pass through holes 289 of lifter tray 236 and into holes 286 of base 288. In the illustrated embodiment, sleeves 287 are made of steel and have an elongated, hollow cylindrical construction with a rounded cross sectional profile and are used to provide support to body portion 250 when component brace 210 is mounted to engine block 212.

It should be appreciated that component brace 210 may be constructed to include more mounting arms or may even be constructed without mounting arms. Component brace 210 may also be constructed to include additional or fewer holes 278 for receiving fasteners 282. In addition, component brace 210 could be constructed without intermediate mounting portions 222 or with alternatively constructed intermediate mounting portions 222. For example, sleeves 287 could be integrally formed on body portion 250, or an elongated intermediate mounting portion extending at least along a portion of the length of body portion 250 could be employed and still allow component brace 210 to function as intended. Component brace 210 may also be constructed of an alternative material and still function as intended within the scope of the present invention. Furthermore, a component brace of similar construction to that of component brace 210 may be used with engine blocks (not shown) produced by the Pontiac Motor Division of the General Motors Corporation that are used in connection with the production of 326, 350, and 455 CID motors.

Although several embodiments of component braces have been disclosed in the drawings and above description, it should be appreciated that additional alternatively embodied component braces could be constructed and still function as intended within the scope of the present invention for use with the engine blocks described above or for use with other engine blocks. For example, component braces may be constructed that only contact an engine block at two points within the upper valley such as, for example, at first and second mounting areas of the engine block adjacent opposite cylinder banks, where such an alternative component brace would still function to resist deformation of the engine block when subjected to loads as an operating motor.

An alternative component brace could also be constructed to contact each cylinder bank in more than one location and/or could be constructed such that it did not extend perpendicularly across the upper valley of the engine block with respect to the rotational axis of the engine block. For example, such a component brace could be constructed to have a generally "X" shaped or "H" shaped configuration when viewed from above the upper valley of the engine block.

Still further, an alternative component brace may be constructed wherein the first and second mounting portions of the component brace do not include arms as disclosed by component braces 10 and 110 discussed above. For example, the first and second mounting portions could be located at the angled side portions with mounting holes extending from the top surface through to the side surfaces. Mounting pins could be secured into the cylinder bank side surfaces to receive such an alternative brace component. In such an embodiment, the pins may extend into the coolant passages of the engine block when installed and, therefore, would require a sealant to prevent leakage. Such an alternative component brace could be used with engine blocks that do not include casting pads, or used in alternative locations on engine blocks having casting pads.

It should also be understood that still further alternatives for securing first and second mounting portions of a component brace to the engine block could be employed within the scope of the present invention. For example, a component brace could be constructed to include arms having pins, flanges, hooks, grooves, slots, or the like, that would mate to a mounting area on the engine block, such as a casting pad or cylinder bank side surface, having a corresponding hole, groove, receptacle, slot, or the like.

Additionally, it should also be understood that alternatively dimensioned component braces and/or alternative materials may be used to construct component braces that would still function as intended within the scope of the present invention. For example, more or fewer transverse holes may be included, or a component brace may be constructed of an alternative metallic material, a polymeric material, a composite material, or the like, and still provide sufficient rigidity when mounted to an engine block. Furthermore, component braces may be used with engine blocks constructed of cast iron, aluminum, or other alloy or material.

The mounting of one or more component braces in the upper valley of V-styled engine blocks provides strength to the engine block to resist deformation of the engine block when used in an operating motor. The component braces include first and second mounting portions separated by a body portion, where the mounting portions may be constructed as arms extending from the body portion. An intermediate mounting portion may also be included that is centrally located with respect to the first and second mounting portions, but below a line defined by the first and second mounting portions. The component brace thus forms an approximately inverted triangular or truss like configuration having three points of contact with three mounting areas on the engine block, with the mounting areas being located proximate the left and right cylinder banks and at the base of the upper valley. The securing of the component brace at the mounting areas provides rigidity to the upper portion of the engine block to resist deformation, such as would occur as relative movement between the cylinder banks. The resistance to such deformation aids in the prevention of cylinder bore wall distortion as well as engine block cracking. Therefore, a motor constructed using an engine block having one or more component braces mounted thereto will utilize less fuel and may operate under higher loads with a reduced risk of failure.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which I claim an exclusive property right or privilege are defined as follows:

1. A component brace adapted to be mounted to the engine block of a motor with the engine block having banks of cylinder bores configured in an angled arrangement to one another, said component brace adapted to be installed within the upper valley of the engine block between the banks of cylinder bores and comprising:

a first mounting portion, said first mounting portion adapted to being secured to a first mounting area on an engine block, the first mounting area being located proximate a first cylinder bank;

a second mounting portion, said second mounting portion being located distal from said first mounting portion and adapted to being secured to a second mounting area on the engine block, the second mounting area being located proximate a second cylinder bank; and a body portion, said body portion extending between and joining said first and second mounting portions;

said component brace adapted to resist deformation of the engine block when the engine block is subjected to loads in an operating motor, wherein said first and second mounting portions comprise first and second arms, and wherein said first and second arms are adapted to be secured to first and second pads on the engine block that form the first and second mounting portions, and wherein said first arm includes a mounting hole and said second arm includes a mounting hole, and wherein mounting pins are included on the first and second pads, said mounting pins being adapted to receive said component brace at said mounting holes.

2. The component brace of claim 1, wherein the engine block includes third and fourth mounting areas configured as third and fourth pads and wherein mounting pins are included on the third and fourth pads, and wherein said component brace further includes third and fourth mounting portions comprising third and fourth arms, said third and fourth arms including mounting holes, said mounting pins included on the third and fourth pads being adapted to receive said third and fourth arms.

3. The component brace of claim 1, wherein when said component brace is mounted to the engine block, said component brace lies in a plane that extends approximately between cylinders of the first and second cylinder banks.

4. The component brace of claim 1, wherein said body portion includes at least one transverse hole.

5. The component brace of claim 1, wherein when said component brace is mounted to the engine block said component brace is oriented substantially transversely to the rotational axis of the engine block.

6. The component brace of claim 1, wherein said component brace is constructed of steel.

7. A component brace adapted to be mounted to the engine block of a motor with the engine block having banks of cylinder bores configured in an angled arrangement to one another, said component brace adapted to be installed within the upper valley of the engine block between the banks of cylinder bores and comprising:

a first mounting portion, said first mounting portion adapted to being secured to a first mounting area on an engine block, the first mounting area being located proximate a first cylinder bank;

a second mounting portion, said second mounting portion being located distal from said first mounting portion and adapted to being secured to a second mounting area on the engine block, the second mounting area being located proximate a second cylinder bank; and a body portion, said body portion extending between and joining said first and second mounting portions;

said component brace adapted to resist deformation of the engine block when the engine block is subjected to loads in an operating motor, wherein said component brace further includes an intermediate mounting portion, said intermediate mounting portion being located between said first and second mounting portions and adapted to being secured to a third mounting area on the engine block, where the third mounting area is located between the first and second cylinder banks; and wherein said component brace includes a length between said first and second mounting portions and a width substantially orthogonal to a plane defined by said first mounting portion, said second mounting portion, and said intermediate mounting portion, said length being greater than approximately seven inches and said width being less than approximately one inch.

8. The component brace of claim 7, wherein said intermediate mounting portion is adapted to contact a lifter tray on the engine block when said component brace is mounted to the engine block such that the lifter tray is positioned between said component brace and the engine block.

9. The component brace of claim 7, wherein said intermediate mounting portion is positioned generally equidistant from said first and second mounting portions, and wherein when said component brace is mounted to an engine block said first and second mounting portions and said intermediate mounting portion define an approximately inverted triangular configuration with said intermediate mounting portion being positioned beneath a line defined by said first and second mounting portions.

10. The component brace of claim 9, wherein said intermediate mounting portion comprises a support element, and wherein said support element extends generally vertically downward from said body portion when said component brace is mounted to the engine block.

11. The component brace of claim 10, wherein said intermediate mounting portion further includes a through hole, said through hole being adapted to align with a hole at the third mounting area of the engine block when said component brace is mounted to the engine block, and wherein said through hole is adapted to receive a fastener, said fastener being adapted to secure said component brace to the engine block.

12. The component brace of claim 9, wherein said intermediate mounting portion comprises a receptacle element, and wherein said receptacle element extends into said body portion and is adapted to mate with the third mounting area of the engine block when said component brace is mounted to the engine block.

13. The component brace of claim 12, wherein said receptacle element defines a substantially arched portion, said arched portion adapted to mate with a substantially convex arched configured third mounting area.

14. The component brace of claim 7, wherein said intermediate mounting portion comprises at least one sleeve, said at least one sleeve adapted to extend generally vertically downward from said body portion when said component brace is mounted to the engine block.

15. The component brace of claim 7, further including mounting pins, said mounting pins adapted to being installed on the first and second mounting areas of the engine block, and wherein said first and second mounting portions each include a mounting hole, said mounting pins being adapted to receive said component brace at said mounting holes.

16. A method of bracing the engine block of a motor having banks of cylinder bores configured in an angled arrangement to one another, where the engine block has at least one first mounting area located in the upper valley of the engine block proximate a first cylinder bank and at least one second mounting area in the upper valley of the engine block proximate a second cylinder bank, said method of bracing comprising:

providing at least one component brace having first and second mounting portions and a body portion extending between the first and second mounting portions; and securing the first and second mounting portions of the at least one component brace to the first and second mounting areas on the engine block, wherein the component brace includes an intermediate mounting portion, and wherein said securing further comprises mounting the intermediate mounting portion of the component brace to a third mounting area on the engine block, where the third mounting area is located between the first and second mounting areas.

17. The method of claim 16, further comprising installing pins on the first and second mounting areas, wherein the at least one component brace includes mounting holes on the first and second mounting portions, and wherein the pins are adapted to receive the component brace at the mounting holes.

18. The method of claim 17, wherein the first and second mounting portions on the component brace comprise first and second arms, and wherein the first and second mounting areas comprise first and second pads.

19. The method of claim 16, wherein the intermediate mounting portion of the component brace includes a through hole adapted to receive a fastener and the third mounting area includes a hole adapted to align with the through hole of the intermediate member, and wherein said securing further comprises mounting the intermediate mounting portion to the third mounting area using a fastener.

20. The method of claim 16, further comprising orienting the component brace substantially transversely to the rotational axis of the engine block prior to securing the first and second mounting portions to first and second mounting areas on the engine block.

21. The method of claim 16, further comprising aligning the component brace in a plane that extends approximately between cylinders of the first and second cylinder banks prior to securing the first and second mounting portions to first and second mounting areas on the engine block.

22. The method of claim 16, wherein the engine block includes a third mounting area proximate one of the cylinder banks and a fourth mounting area proximate the other cylinder bank, and wherein the at least one brace further includes third and fourth mounting portions, with the body portion extending between the third and fourth mounting portions, and wherein said securing further comprises securing the third and fourth mounting portions of the at least one component brace to the third and fourth mounting areas on the block.

* * * * *